United States Patent [19]

Malsbury et al.

[11] Patent Number: 4,726,109

[45] Date of Patent: Feb. 23, 1988

[54] UNHEADING DEVICE AND METHOD FOR COKING DRUMS

[75] Inventors: Allen J. Malsbury, Parsippany, N.J.; Steve D. Mehas, Badgor, Pa.; Myron Krawchuk, Newton, N.J.

[73] Assignee: Foster Wheeler USA Corporation, Clinton, N.J.

[21] Appl. No.: 917,443

[22] Filed: Oct. 9, 1986

[51] Int. Cl.[4] ..... C10B 43/02

[52] U.S. Cl. ..... 29/402.08; 29/402.03; 202/241

[58] Field of Search ..... 29/402.03, 402.08; 202/241

[56] References Cited

U.S. PATENT DOCUMENTS

| | | | |
|---|---|---|---|
| 3,160,573 | 12/1964 | Nepomniashtshy | 202/241 |
| 3,836,434 | 9/1974 | Novy | 202/241 |
| 4,611,613 | 9/1986 | Kaplan | 202/241 |
| 4,626,320 | 12/1986 | Alworth et al. | 202/241 |

*Primary Examiner*—P. W. Echols
*Assistant Examiner*—Irene Graves Golabi
*Attorney, Agent, or Firm*—Marvin A. Naigur; Martin Smolowitz

[57] ABSTRACT

A device for remotely unheading delayed coking drums and method for remotely operating the device. The device includes a head unit for attachment to a lower flange of a coking drum and fastening means by which a plurality of swing bolts are disconnected by remotely operated detensioning equipment, and a platform device which lowers the header unit, moves it laterally to one side, and tips it for cleaning. A chute attached to the platform is brought into engagement with the coke drum lower flange for removal of coke from the drum. Following the coke removal, the chute is removed and the head unit is remotely reconnected to the coker drum lower flange. The invention also discloses a method for remotely operating the unheading device.

15 Claims, 16 Drawing Figures

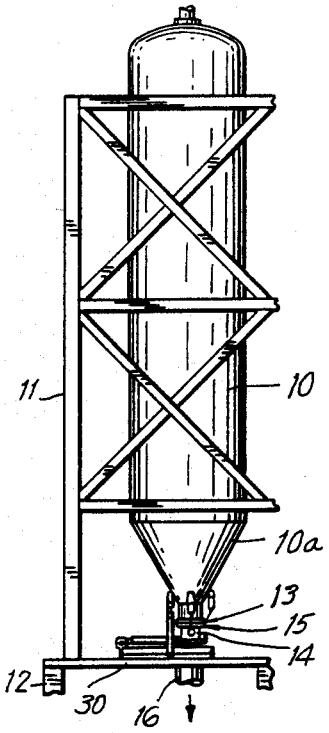
FIG. 1
FIG. 2
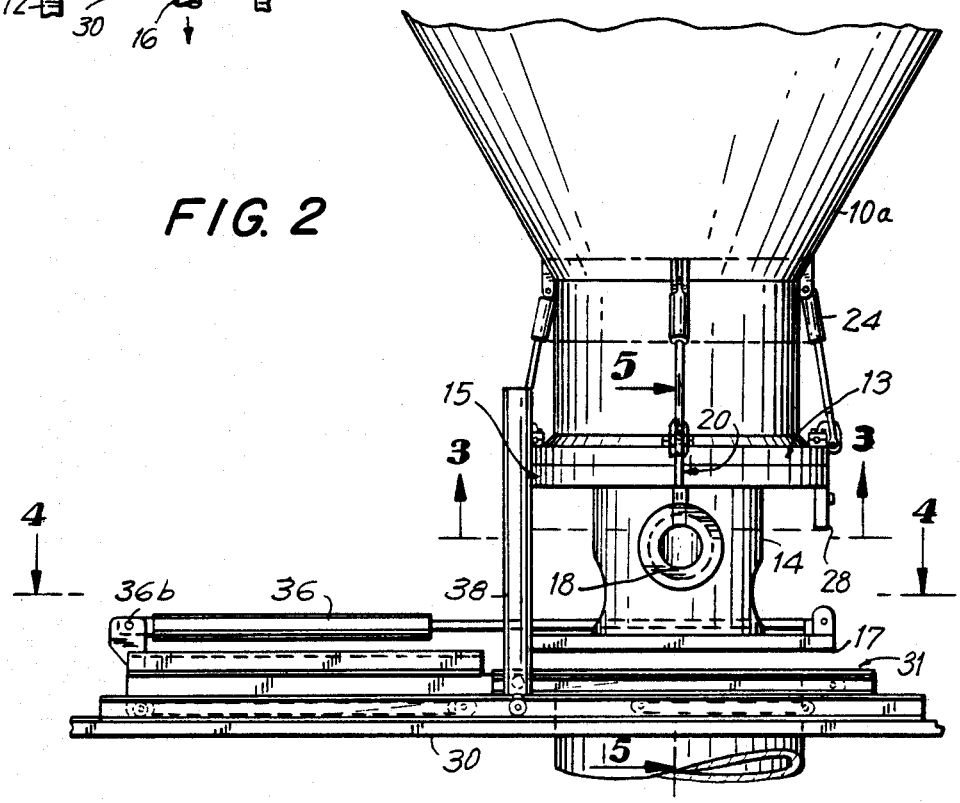

FIG. 4
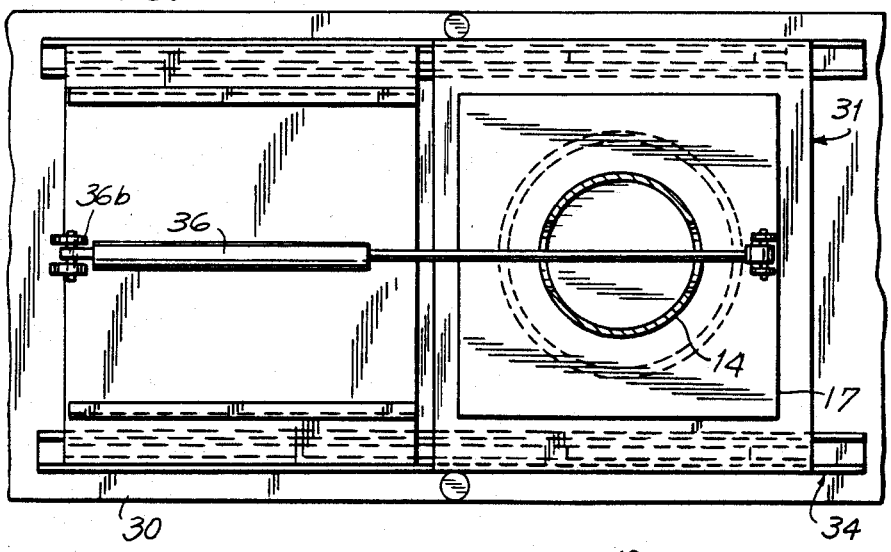
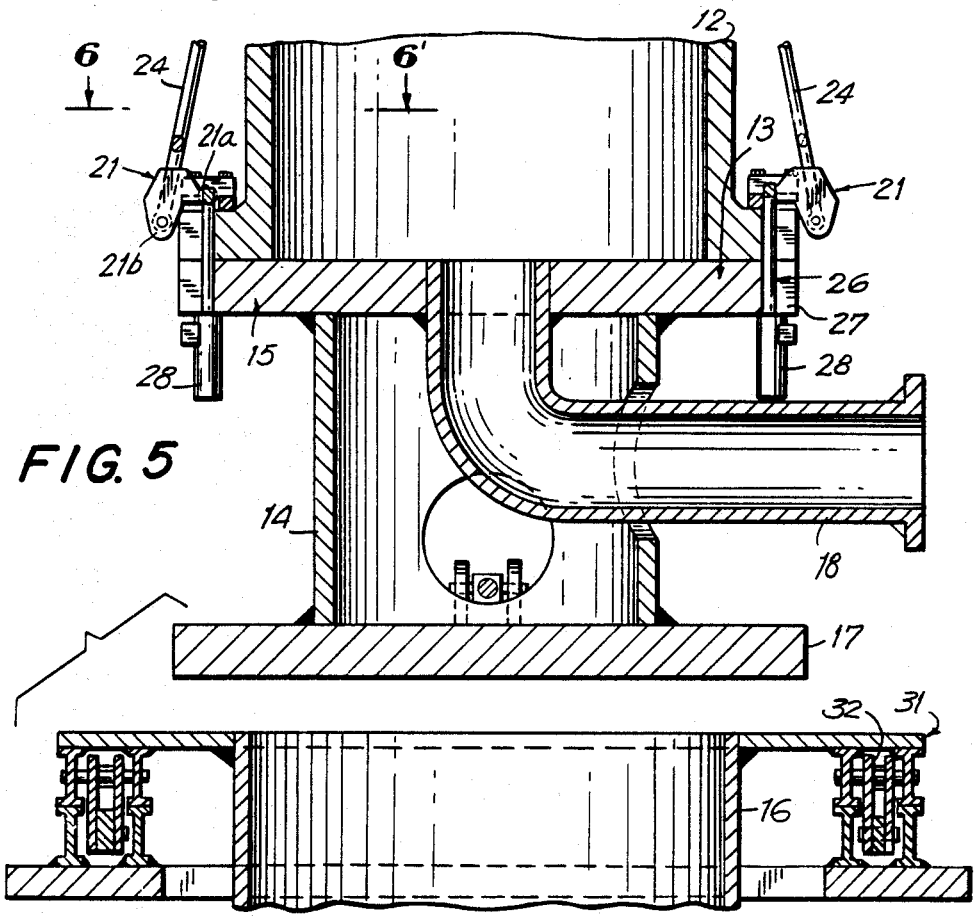
FIG. 5

UNHEADING DEVICE AND METHOD FOR COKING DRUMS

BACKGROUND OF INVENTION

This invention pertains to an unheading device for coking drums which is capable of remote operation. It pertains particularly to such an unheading device for removing and replacing a lower head unit for delayed coking drums and to a method for remote operation of the unheading device.

During the operation of delayed coking drums or units for coking of various hydrocarbon feedstreams in petroleum refinery operations, the resulting coke is deposited on the inner walls of the drum and must be periodically removed, usually at 36–48 hour intervals. Such coke removal is accomplished through an opening in the lower end of the vertically-oriented drum, and is presently accomplished by manually removing a lower head unit and installing a chute to direct the coke removed to a desired location, such as to a hopper or rail car. Because the coker drum operates at relatively high temperatures of 500°–900° F., such removal of the hot coker drum lower head by manual means is slow and somewhat hazardous and is therefore undesirable. The present invention advantageously provides a novel unheading device for remote safe removal and replacement of coke drum lower head units and thereby provides for more rapid removal of coke from the drum during decoking operations.

SUMMARY OF INVENTION

The present invention provides an unheading device for remote unfastening and removal of a head unit from a coking drum or vessel lower end and for its subsequent replacement on the drum. The device according to the invention includes a head unit adapted for fastening to a lower flange of a coking drum; pivotable clamping means and bolt detensioning means for unfastening a plurality of bolts in the flange and swinging the bolts radially outwardly and upwardly so as to permit downward removal of the head unit; a vertically movable platform means adapted for supporting and lowering the head unit from the drum flange and moving it laterally to a side position, and piston means for tipping the head unit through an angle of 20°–60° with the horizontal plane to permit it to be cleaned. The device also includes a chute attached to the lower side of the platform, so that the chute is raised to contact the coker vessel flange as the head unit is tipped. The unheading device provides for the head unit to be returned laterally so as to be in vertical alignment with the coker vessel lower flange and then lifted up into engagement with the coker lower flange, after which the head unit fasteners are refastened into place.

The fasteners of the unheading device are pivotally attached to the coker vessel lower flange, so as to be swung radially outwardly and upwardly by vertically-oriented piston actuators attached to the vessel and thus permit lowering the head unit. The platform means includes upper and lower plates having dual lift lever linkages provided therebetween, and is operated by dual hydraulic piston actuators attached to the upper and lower plates of the platform. A chute is attached to the platform upper plate for use in removing the coke from the coking drum. After unfastening the head unit mating flanges, the platform means lowers the head unit by operation of the piston actuator and moves it laterally from beneath the coker drum by another piston actuator which preferably extends through a lower portion of the head unit. The platform movement also raises the coke chute into contact with the coking drum lower flange for a decoking position, and also tilts the head unit into a suitable position for cleaning by action of the vertical piston located between the upper and lower plates of the platform.

After decoking the coke drum is completed, the platform is adapted to lower the coke chute and then move the head unit laterally to a position back under the drum lower flange, then raise the head unit into mating position for rebolting to the drum lower flange. The bolt detensioning and lift mechanisms for the head and coke chute can be advantageously operated by hydraulic pistons operated by remote control. This lift and chute arrangement can be advantageously used for either new or existing delayed coking drums to decoke the drums much more rapidly and with increased safety at intervals of 36–48 hours.

The invention also provides a method for removing such coker lower head units for coke removal and cleaning, and replacing the head unit on the coking drum or vessel. The method includes the steps of unfastening a flanged joint provided between a lower flange of the delayed coking vessel and a removable head unit by detensioning a plurality of bolt fasteners using remotely operated hydraulic devices for detensioning the fastener bolts, and swinging the bolts radially outwardly and upwardly, then lowering the head unit and moving it laterally to a side position. Next, the head unit is tipped at an angle of 20°–60° with the horizontal plane for cleaning the unit, while also connectiing a chute to the coking vessel lower flange for removing the coke contents from the vessel. Following such head unit cleaning and coke removal, the chute is lowered and the head unit is moved laterally so as to be in vertical alignment with the coking vessel lower flange, and then raised back into position against the vessel flange. The fastener bolts are then swung into position and retensioned to reconnect the head unit onto the coker vessel lower flange.

It is an advantage of this invention that a coker drum lower head unit can be conveniently removed from the coker drum using a remotely operated unheading device, which loosens the plurality of bolt fasteners and pivots the fasteners outwardly, then lowers the head unit and moves it laterally aside. Such unheading device and method permits more rapid and safe removal of coke deposited in a coking drum, so as to increase the available operating time for the drum, and also improves personal safety by avoiding undesirable exposure of personnel to hot hydrocarbons, steam and water during such unheading operations.

BRIEF DESCRIPTION OF DRAWINGS

This invention will be further described with reference to the following drawings, in which:

FIG. 1 shows a vertically-oriented delayed coking drum with a removable lower head unit and platform support means provided at the drum lower end;

FIG. 2 shows an enlarged elevation view of the coking drum head unit attached to the lower end of the drum by a plurality of fastener means and a lift platform device provided below the head unit;

FIG. 4 shows a plan view of the unheading device taken at line 4—4' of FIG. 2;

FIG. 5 shows a sectional elevation view taken through the head unit at line 5—5' of FIG. 2, and also shows the coker head unit prior to its engagement by the head lift platform support;

DETAILED DESCRIPTION OF INVENTION

Figure 3:
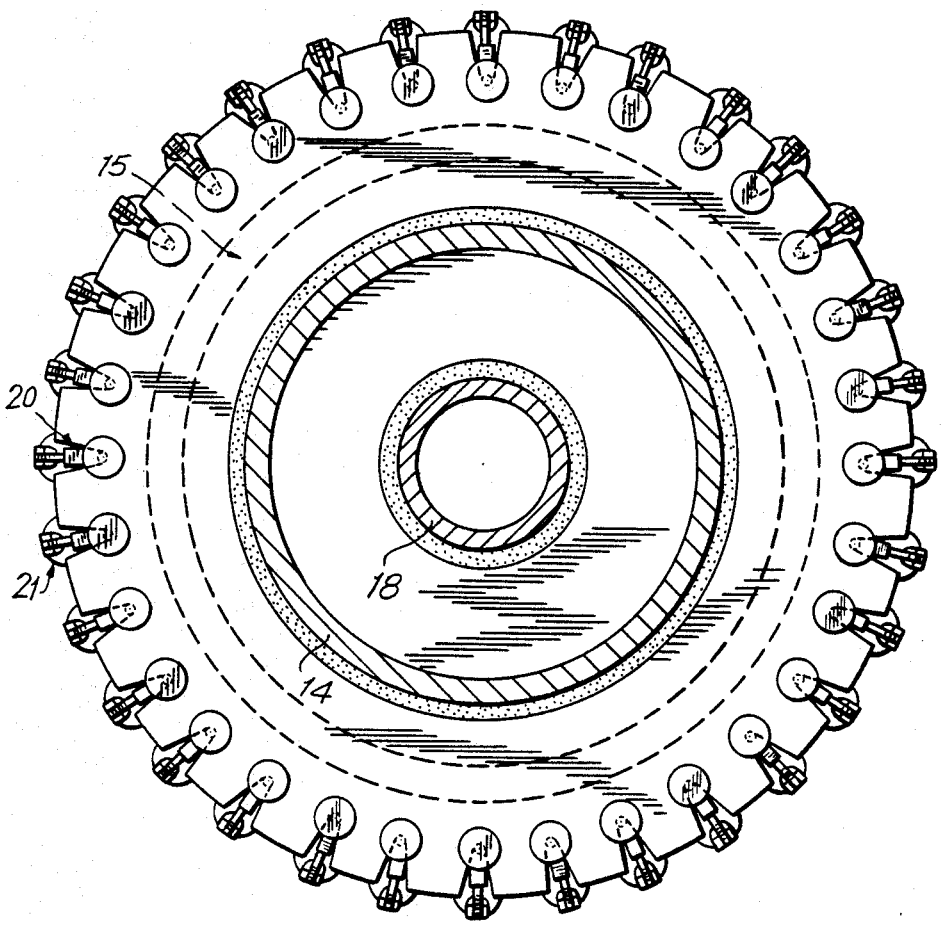
FIG. 3 shows an enlarged cross-section view taken at line 3—3′ of FIG. 2 and shows detensioning and actuator means for removing the multiple fasteners in the lower flange of the coker drum.
Figure 6:
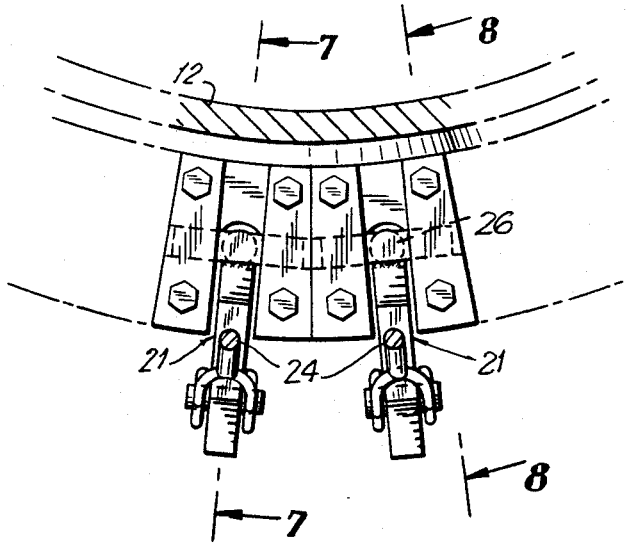
FIG. 6 shows a detail plan view of the flange clamp fastening device taken at line 6—6' of FIG. 5.
Figure 7:
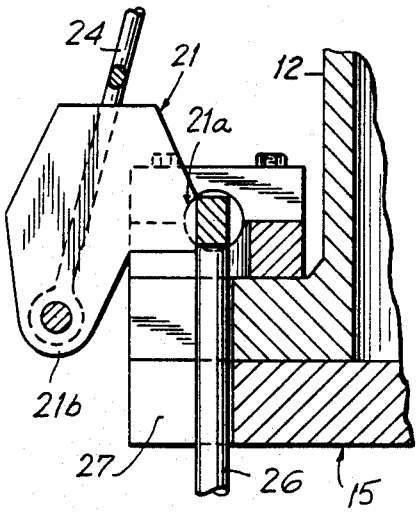
FIG. 7 shows a sectional elevation view taken through the flange clamp fastener device at line 7—7' of FIG. 6.
Figure 8:
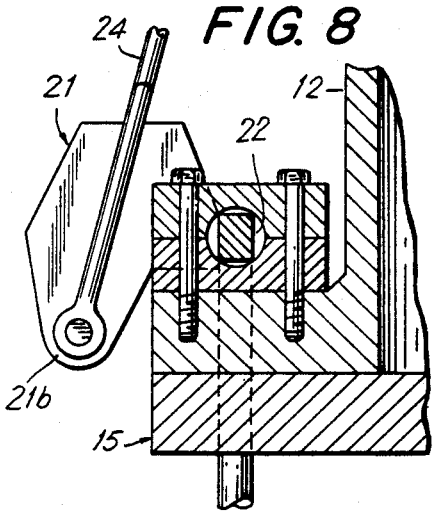
FIG. 8 shows another sectional elevation view of the flange clamp fastener taken at line 8—8' of FIG. 6.

As generally shown in FIG. 1, a delayed coking drum or vessel 10 is vertically-oriented and supported by an adjacent frame structure 11 and also supported by a platform structure 12 provided below the ddrum 10. Such delayed coking drums 10 for use in petroleum refineries are usually 20–26 ft. diameter and 80–100 ft. tall, and have a tapered lower portion 10*a* attached to a lower flange 13 which is usually 5–7 ft. diameter. A removable head unit 14 is pressure-tightly attached to flange 13 by a plurality of clamp fastener means 20. The coke deposited in coking drum vessel 10 is removed from the drum periodically as needed by removing the head unit 14 and cutting the coke from within the vessel, so that the coke falls through a chute 16 into a storage pit, pad or rail car (not shown).

The head unit 14, which is fastened onto lower flange 13 by pivotable multiple clamp fastener means 20, is shown in greater detail by FIG. 2. It will be noted that head unit 14 includes a lateral conduit 18 used for feeding hydrocarbon, steam and water materials into the coker vessel 10. Conduit 18 is also used to drain water from the drum 10. As is shown in FIG. 2 and further shown in FIG. 3, 16–48 swing type fasteners 20 are provided evenly spaced around the periphery of flange 13 for clamping upper flange 15 of the head unit 14 onto flange 13 of vessel 10.

As shown in greater detail by FIGS. 5–8, each clamping device 20 is constructed and operated similarly, and includes a clamp arm 21 which is pivotably attached at its upper end 21*a* to flange 13 by a pivot pin 22 pivotably secured to the upper surface of flange 13 at near the outer perimeter of the flange. The other or lower end 21*b* of clamp arm 21 is pivotally attached to a lower end of a piston actuator 24, and the upper end of actuator 24 is pivotably attached at 25 to the outer wall of coker drum 10. The lower end 21*b* of each clamp 21 is also rigidly connected via pivot pin 22 to the upper end of a bolt 26, which is provided in a vertical slot 27 provided in both the lower flange 13 of vessel 10 and in the mating upper flange 15 of the head unit 14. Also, a remotely operated tensioning unit 28 is provided attached to each bolt 26 below flange 15. The bolt tensioning device 28 may be similar to that described in U.S. Pat. No. 3,015,975 to Biach, which is incorporated herein by reference to the extent necessary to adequately disclose the present invention. The tensioning units 28 are usually operated by a suitable hydraulic pressure source.

When it is desired to open the joint between the mating flanges 13 and 15, the bolt tensioning units 28 are first remotely actuated to detension the bolts 26 thereby lowering the head unit 14 by a distance of 0.25–1 inch onto top plate 31 of a lift platform support device 30. Then, the swing actuator pistons 24 are actuated so as to swing the bolts 26 outwardly and upwardly to a disconnected or unfastened position as shown in FIG. 9.

Figure 11:
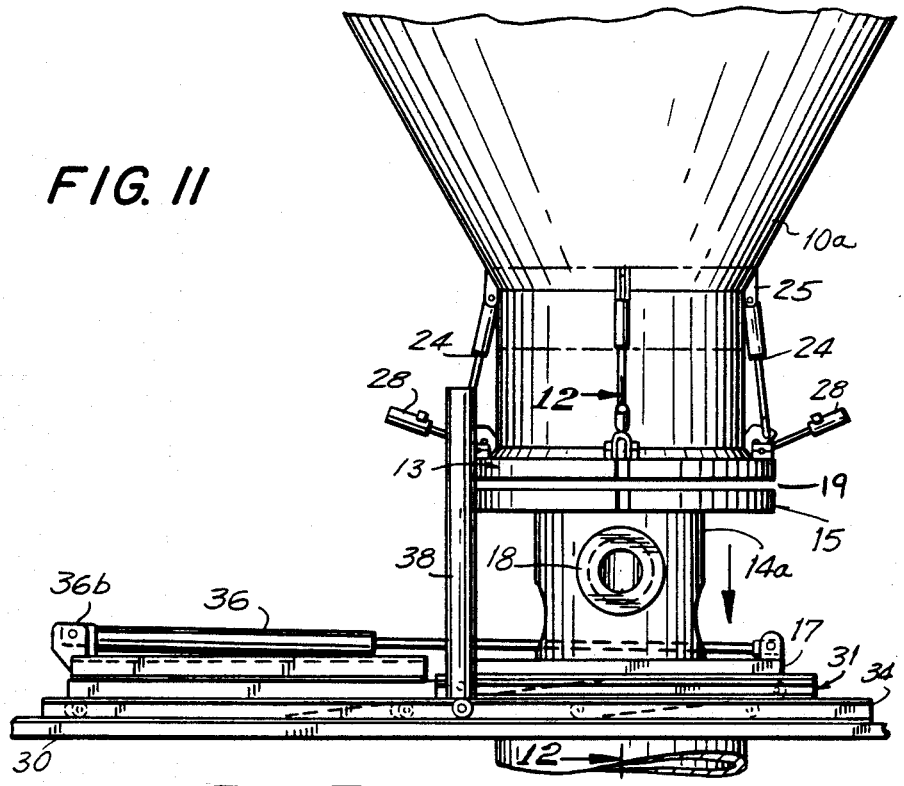
FIG. 11 shows an elevation view similar to FIG. 9 but showing the coker head unit being lowered from the coker vessel.
Figure 13:
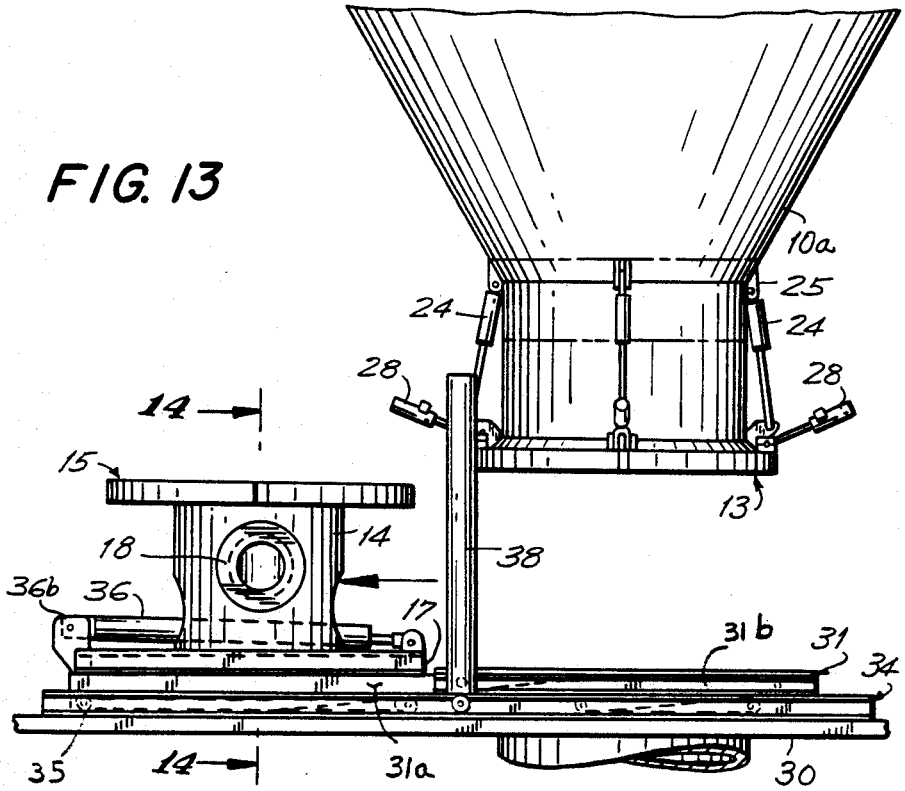
FIG. 13 shows an elevation view of the coker head unit after being moved laterally away from the coker vessel lower flange.
Figure 14:
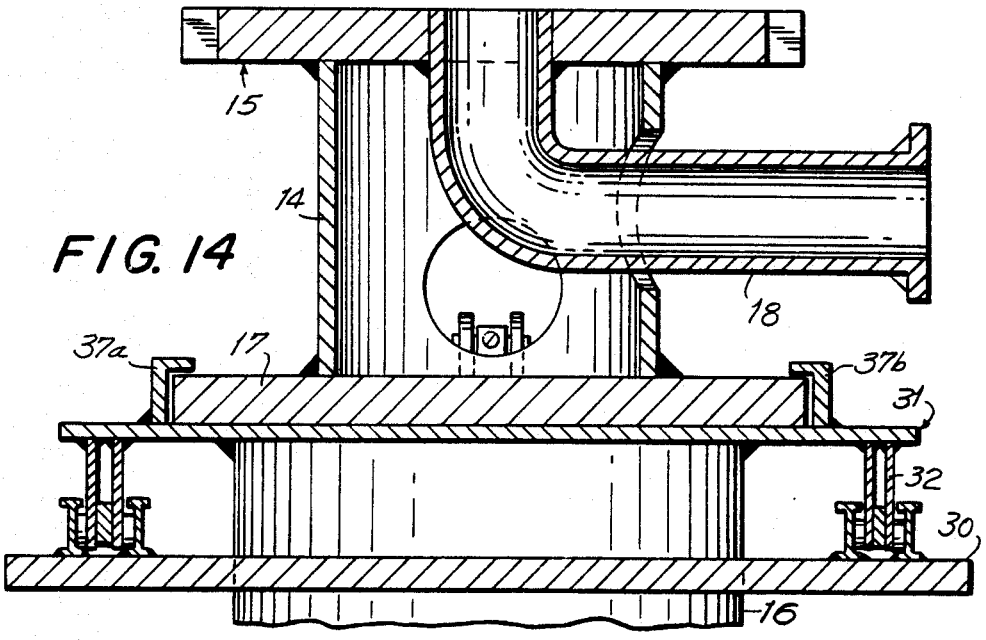
FIG. 14 shows an enlarged sectional elevation view of the head unit taken at line 14—14' of FIG. 13.

For supporting and removing the head unit 14 from the coker vessel lower flange 13, lift platform support device 30 is provided below head unit 14, as is shown in FIGS. 2, 4 and 5. The platform device 30 is adapted for contacting the lower support plate 17 of head unit 14, as additionally shown by FIGS. 9 and 10. Platform device 30 includes upper plate 31 and is pivoted lifting levers 32 and 33 pivotably and slidably attached to upper plate 31 and to lower plate 34. After the fastener bolts 26 have been detensioned and the head unit initially lowered by 0.25–1 inch to provide a gap 19 between flanges 13 and 15 and head unit 14 is being supported by upper plate 31 of platform device 30, the bolts 26 are then swung radially outwardly and upwardly from flanges 13 and 15. Then the head unit 14 is further lowered and is moved laterally to one side, as shown by FIGS. 9, 11 and 13. These vertical and lateral movements for head unit 14 are accomplished by the plate 31 being vertically movable by dual toggle connectors 32 and 33 provided pivotably attached between upper plate 31 and lower base plate 34, in combination with a vertically oriented piston actuator 38.

After the head unit 14 has been lowered by action of piston actuator 38 as shown by FIG. 11, the head unit is moved aside by horizontal piston actuator 36, one of which preferably extends through openings 14*b* in head support portion 14*a*, and is preferably connected at one end to head unit 14 at 36*a*. The orientation and relative position of the parts of lifting platform device 30 is shown in a plan view of platform support device 30 by FIG. 4. Also, FIG. 10 shows an enlarged view of head unit 14, which shows upper support plate 31 in position in contact with lower plate 17 of head unit 14.

Figures 9, 10:
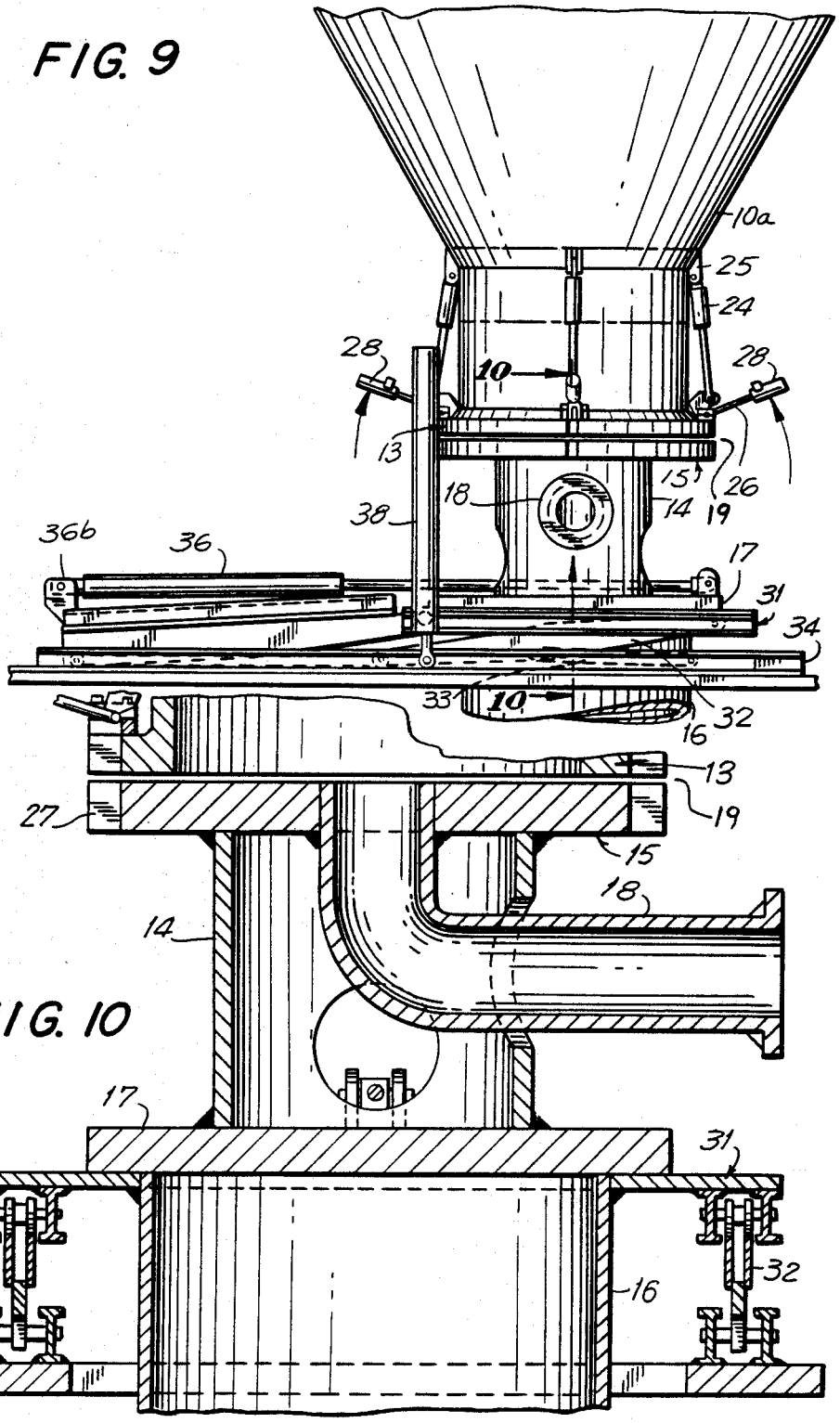
FIG. 9 shows an elevation view similar to FIG. 2, but after the lift platform device has contacted the head unit and the flange fastener clamps have been unlatched.
FIG. 10 shows an enlarged sectional elevation view similar to FIG. 5 but after the lift platform device has contacted the coker head unit.
Figure 12:
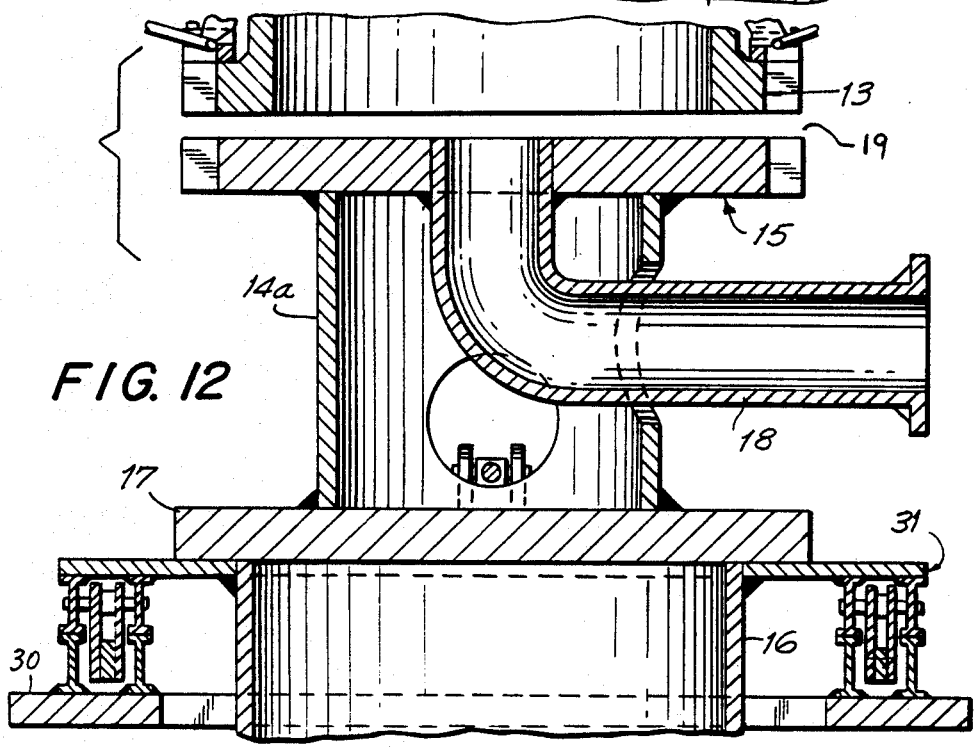
FIG. 12 shows an enlarged cross-sectional elevation view of the head unit taken at line 12—12' of FIG. 11.

As seen in FIGS. 9 and 10, the upper plate 31 of the platform device 30 is raised to be in within 0.25–1 inch of contact with plate 17 by action of the linkage members 32 and 33, which are slidably attached at their lower ends to plate 34. The head unit 14 is first lowered by 0.25–1 inch while detensioning bolts 26 using bolt tensioning devices 28 onto plate 31, and is then further lowered by action of platform device 30 linkage members 32 and 33, as shown in FIGS. 11 and 12.

Figure 15:
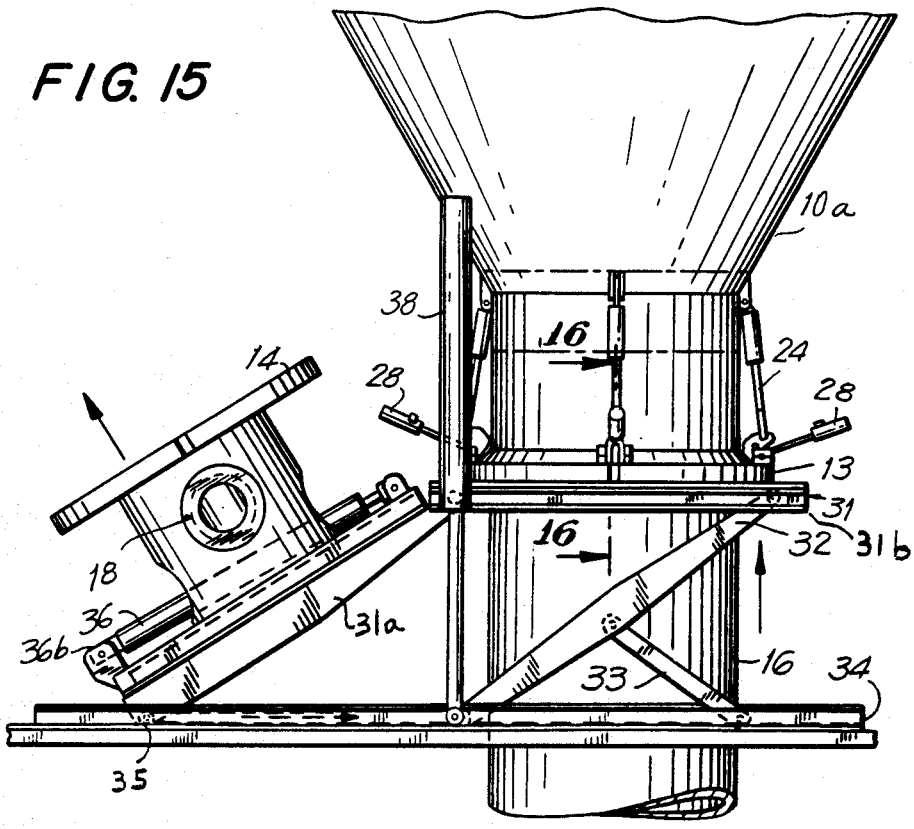
FIG. 15 shows an elevational view of the head unit after being tipped for cleaning, and a chute connected to the coker drum lower flange for removal of the coke contained therein.
Figure 16:
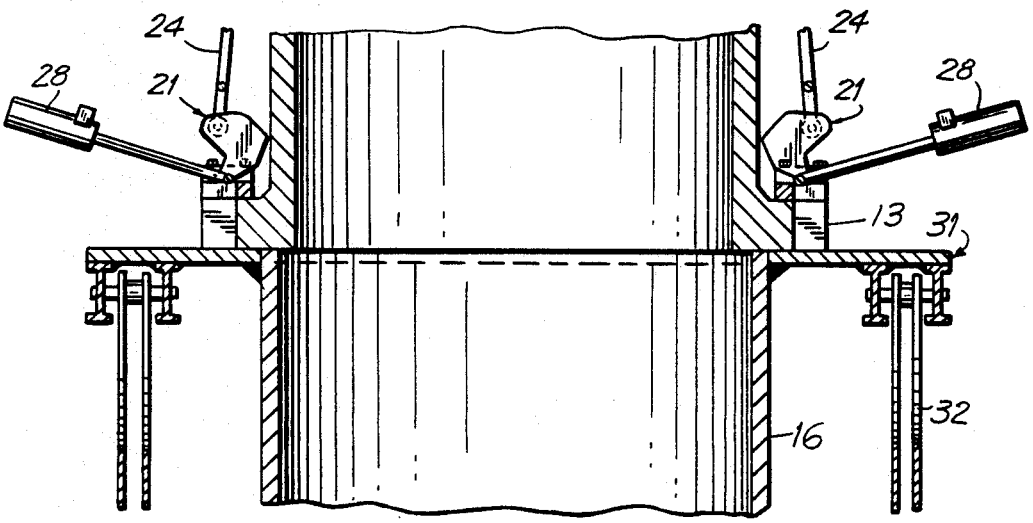
FIG. 16 shows an enlarged vertical sectional view of the coker flange and connected chute taken at line 16—16' of FIG. 15.

Following such lowering of the head unit 14, it is then moved laterally to an offset position at one side as shown by FIG. 13 by retraction action of the piston actuator 36. The lower plate 17 of head unit 14 is retained by dual brackets 37*a* and 37*b*, which are fixed to tipped portion 31*a* of upper plate 31. Then after head unit 14 has been moved laterally to one side and retained in brackets 37, it is also tipped upwardly at an angle of preferably 30°–50° to the horizontal plane at pivot 35 by action of piston 38, as is shown by FIG. 15. This tipped position of head unit 14 permits manually cleaning the head interior portion and also permits cleaning the conduit 18 attached thereto. Also, chute 16 which is attached to untipped portion 31*b* of upper plate 31 of the platform device 30, is simultaneously raised by action of linkages 32, 33 and piston actuator 38 so that chute 16 contacts the lower flange 13 of the coker vessel 10. An enlarged partial view of the chute 16 being in contact with the lower flange 13 of the coker vessel 12 is shown by FIG. 16. The coke is removed from within drum 10 and falls through chute 16 to a storage pit or rail car (not shown).

After the decoking operation for the coker drum 10 is completed, the head unit 14 is lowered and returned to its original position and reconnected onto the drum flange 13. This return movement is accomplished by first lowering platform 31 by actuator piston 38 then extending piston actuator 36 to move head unit 14 laterally to a position in vertical alignment below flange 13, then raising platform 31 so that head unit 14 is again placed against flange 13. Next, the swing actuators 24 are extended so as to pivot the bolts 26 downwardly into the slots 27. Then the multiple tensioning units 28 are actuated so as to clamp the mating flanges 13 and 15 tightly together again.

This invention will be further described by the following example of operations, which should not be construed as limiting the invention.

EXAMPLE

In a coking drum used for delayed coking of petroleum feedstocks, after 36–48 hours of operation sufficient coke is deposited on the inner walls of the drum that removal of the coke is required before continued operation. The coking drum, which is equipped with a lower head unit constructed and operated in accordance with this invention, is shut down, depressurized and the lower head unit is removed. Important characteristics of the coker drum head unit and unheading device are as follows:

Coker lower flange diameter, in.: 72
Head unit flange diameter, in.: 72
Header length, in.: 18
Number of fastener swing bolts: 36
Swing bolt diameter, in.: 2
Bolt slot width, in.: 2.5
Vertical movement of lift platform, in.: 12
Lateral movement of head unit, in.: 84
Lift actuator hydraulic pressure, psig: 1500

Following switch out of hydrocarbon feed, steam out, water quench and draining of the coking unit, the lower head unit is removed and replaced using the following procedure:

(a) Detension the fastener swing bolts by loosening the hydraulically-operated bolt tension units sufficiently to lower the bottom head unit 0.25–1 inch onto a lift platform, and permit the bolts to swing outwardly from the flange periphery.

(b) Pressurize the swing actuators and swing the fastener bolts outwardly and upwardly, thus freeing the head unit flange from the coking drum flange.

(c) Depressurize the lift platform actuators and lower the head unit, then move it aside by pressurizing and retracting the lateral actuator piston.

(d) Repressurize the lift actuator to move the coke chute upwardly to mate with the coking drum lower flange to permit removal of the coke, and also to tip the head unit to facilitate manual cleaning of the unit.

(e) Following removal of accumulated coke from the coking drum, lower the coke chute, move the head unit laterally to be in vertical alignment with the coking drum flange, and then lift the head unit to mate with the coking drum flange.

(f) Repressurize the swing actuator pistons to swing the bolts downward into the bolt slots, then actuate the tensioning units to retension the flange bolts to securely clamp the head unit onto the lower flange of the coking drum.

Although this invention has been disclosed broadly and in terms of a preferred embodiment, it will be understood that modifications and variations can be made within the scope of the invention, which is defined by the following claims.

I claim:

1. An unheading device for removal and replacement of a lower head unit of a coking drum, comprising:

(a) a head unit adapted for fastening to a lower flange of a coking drum;

(b) at least eight pivotable clamping devices each including detensioning means equally spaced around the perimeter of said head unit for detensioning and pivotably removing bolts located between said lower flange and an upper flange of said head unit to unfasten the head unit from said lower flange;

(c) platform means adapted for vertical movement to contact a lower side of said head unit and for lowering the head unit, and then moving it laterally to a side location relative to said lower flange;

(d) means for tipping said head unit in the side location at an angle of 20°–60° with the horizontal plane; and (e) means for lowering said head unit then moving it laterally and lifting said head unit to contact the coking drum lower flange, and refastening the head unit into place on the coking drum.

2. The apparatus of claim 1, wherein each said clamping device is pivotably attached to said coking drum lower flange, and each said bolt is attached to each clamping device, whereby the bolts can be swung radially outwardly and upwardly to unfasten the flange joint.

3. The apparatus of claim 1, wherein said bolt detensioning means are provided at a lower end of the bolts and are each adapted to be operated by hydraulic pressure means.

4. The apparatus of claim 1, wherein said paltform means includes an upper and a lower plate, said upper plate being supported by a pivotable linkage provided between the upper and lower plates, said linkage being moved by hydraulically-operated piston means connected to the upper and lower plates.

5. The apparatus of claim 1, wherein said means for moving said head unit laterally includes a hydraulic actuator piston having one end extending horizontally through said head unit.

6. The apparatus of claim 4, wherein said upper plate includes dual brackets for retaining said head unit onto said upper plate when the head unit is tipped to an angle of 20°-60° with the horizontal plane.

7. The apparatus of claim 1, including a coke chute attached to said paltform means upper flange for contact with the coker drum lower head flange for removing coke from the drum.

8. The apparatus of claim 1, wherein 16–48 clamping devices with attached bolt detensioning means are provided equally-spaced around the periphery of said head unit.

9. An unheading device for removal and replacement of a lower head unit of a vertically-oriented coking drum, comprising:

(a) a head unit adapted for remote fastening to a lower flange of a coking drum;

(b) at least eight pivotable clamping devices and associated detensioning means equally spaced around the perimeter of said head unit for detensioning and pivotably removing bolts located between said lower flange and an upper flange of said head unit, said bolts being each attached at their upper end to the lower end of each said clamping device;

(c) platform means adapted for vertical movement to contact a lower side of said head unit and adapted for lowering the head unit and then moving it laterally to a side location relative to said lower flange, said platform means including an upper and lower plate separated by a linkage means located therebetween;

(d) means for tipping said head unit in the side location at an angle of 20°-60° with the horizontal plane; and (e) means for lowering said head unit then moving it laterally and lifting said head unit to contact the coking drum flange for refastening the head unit into place on the coking drum.

10. A method for removing and replacing a lower head unit for a coking drum, the method comprising:

(a) unfastening a flange joint between a lower head of a coking drum and a removable head unit attached thereto by detensioning a plurality of pivotable bolts and swinging the bolts outwardly and upwardly relative to the flange joint;

(b) lowering the head unit from the coking drum and moving it laterally to a position at one side of the coking drum opening; then (c) moving the head unit laterally into position in vertical alignment with the coking drum lower flange, then raising the head unit into position against the flange of the coking drum lower head; and (d) refastening the pivotable bolts of the flange joint between the head unit and the coking drum.

11. The method of claim 10, wherein the bolts of the flange joint are each detensioned by remotely-operated hydraulic devices attached to each bolt.

12. The method of claim 10, wherein the head unit is lowered and moved laterally to one side by hydraulic piston actuator means attached to the head unit.

13. The method claim of claim 12, including the step of tipping the head unit at an angle of 20°-60° with the horizontal plane while simultaneously raising a chute into contact with the coking drum flange, before moving the head unit into position against a lower flange of the coking drum for refastening the head unit to the coking drum.

14. The method of claim 10, wherein the bolts in the flange joint are refastened by remotely swinging the bolts downwardly to enter slots in the flange joint, and including retensioning the bolts in the flange joint between the head unit and the coking vessel.

15. A method for removing and replacing a lower head unit for a vertically-oriented coking drum, the method comprising:

(a) unfastening a flange joint between a lower head of a coking drum and a removable head unit attached thereto by detensioning a plurality of pivotable bolts and swinging the bolts radially outwardly and upwardly relative to the flange joint, said bolts each being pivotally attached to a lower flange of the coking drum;

(b) lowering the head unit away from the coking drum lower flange by a hydralically actuated platform and moving the head unit laterally to a position at one side of the drum opening;

(c) tipping the head unit while raising a chute into contact with the coking drum lower flange;

(d) lowering the head unit and moving it laterally to a position in vertical alignment with the coking drum lower flange;

(e) raising the head unit into position against the coker drum lower flange; and (f) swinging the pivotable bolts downwardly into engagement with the flange and retensioning the bolts of the flange joint between the coking drum and the head unit.

* * * * *